United States Patent [19]

Cook, Jr. et al.

[11] Patent Number: 4,767,016

[45] Date of Patent: Aug. 30, 1988

[54] LIQUOR BOTTLE CAPPING ASSEMBLY

[75] Inventors: Harold Cook, Jr., Evergreen; Bruce A. Moen, Golden, both of Colo.

[73] Assignee: Adolph Coors Company, Golden, Colo.

[21] Appl. No.: 86,567

[22] Filed: Aug. 18, 1987

[51] Int. Cl.[4] ..... B65D 55/02

[52] U.S. Cl. ..... 215/230; 215/308; 215/232; 220/88 A; 53/420; 53/490; 222/189

[58] Field of Search ..... 215/308, 230, 232, 250; 220/88 A, 372; 222/3, 189, 479, 482; 53/420, 488, 490, 484

[56] References Cited

U.S. PATENT DOCUMENTS

| | | | |
|---|---|---|---|
| 920,791 | 5/1909 | Tonini | 215/308 |
| 1,105,276 | 7/1914 | Jasper | 220/88 A |
| 2,052,728 | 9/1936 | Stewart | 215/308 X |
| 4,328,905 | 5/1982 | Hardt | 220/359 |
| 4,637,519 | 1/1987 | Dutt et al. | 215/232 |

*Primary Examiner*—Donald F. Norton

*Attorney, Agent, or Firm*—Klaas & Law

[57] ABSTRACT

A liquor bottle capping assembly comprising a perforated member fixedly attachable to the liquor bottle in covering relationship with a threaded opening in the liquor bottle for preventing flame propagation into the liquor bottle; a penetration discouraging device operatively associated with the perforated member for discouraging and providing evidence of penetration of the perforated member as by a hypodermic needle; a sheet fixedly attached to the penetration discouraging device and tearably removably attached to the perforated member for sealing the bottle opening and for providing evidence of tampering with the capping assembly; a cap threadably attachable and detachable on the threaded opening for providing a removable and reattachable closure for the liquor bottle opening.

26 Claims, 3 Drawing Sheets

FIG. 3.
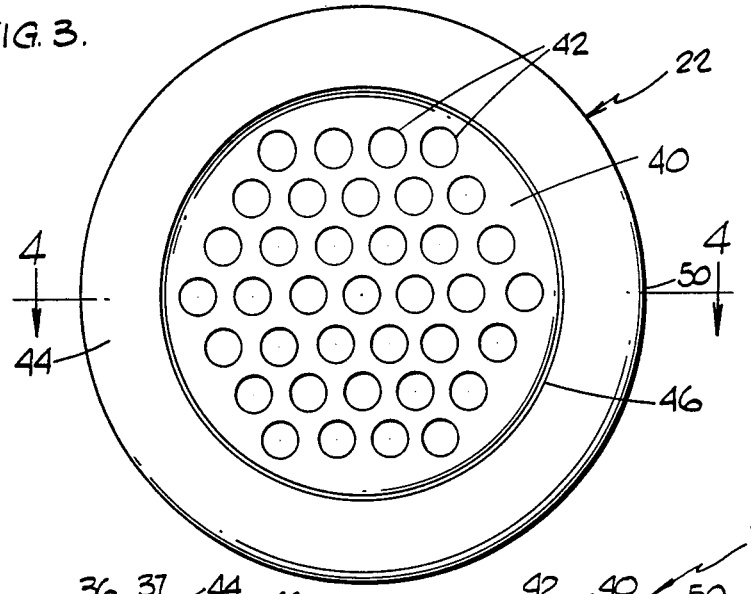
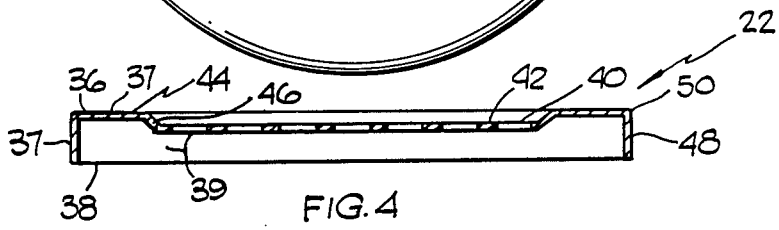
FIG. 4
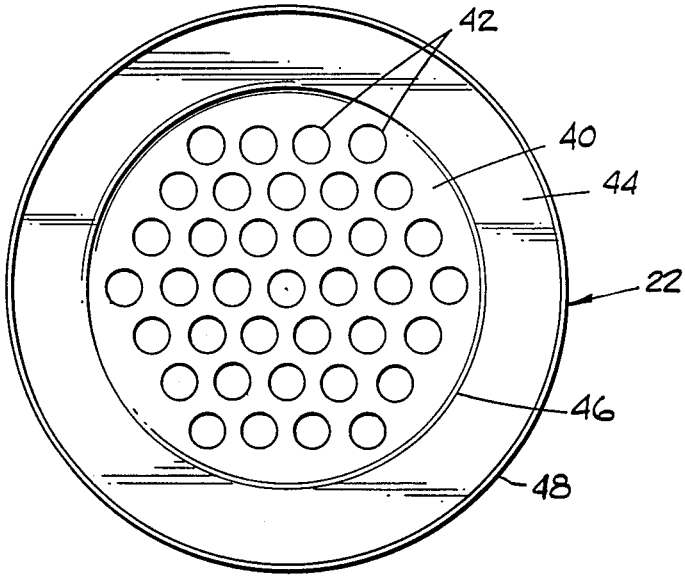
FIG. 5.
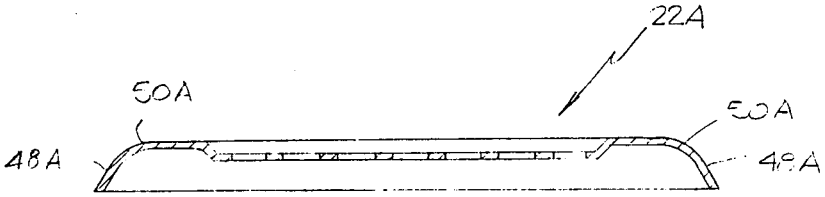
FIG. 6.

LIQUOR BOTTLE CAPPING ASSEMBLY

BACKGROUND OF THE INVENTION

The present invention relates generally to capping assemblies for liquor bottles, and, more particularly, to a liquor bottle capping assembly including a perforated member for preventing flame propagation into the liquor bottle and for discouraging the watering of liquor contained in the associated liquor bottle; a solid disk member and associated sheet member for preventing tampering with the contents of the liquor bottle and providing evidence of any tampering; and a cap member for providing a resealable closure of the liquor bottle opening.

During the last century, a small woven mesh screen known as a Davies screen was used on miners' lanterns in order to prevent flame from the lantern enclosed by the screen from igniting gas pockets encountered in mining operations. A similar woven mesh is used at the openings of gasoline containers to prevent flame propagation into the containers. However, attempts to use such screen-type devices on a liquor bottle to prevent flame propagation into the liquor bottle have proven unsuccessful. It was found that a woven mesh screen so significantly retards the flow rate of liquor poured from a liquor bottle as to make such a screen unusable. Such woven meshes also tend to cause a crystallization phenomenon during the period when the liquor sits unused in the bottle which causes the mesh to clog and further restrict the pouring of liquor from the bottle. Such meshes also proved to be difficult to attach to the glass mouth of a liquor bottle in a commercially feasible manner. Finally, it was found that, with many types of liquor, ignition of alcohol being poured from the container caused a crusting or "caramelization" of the screen mesh which would significantly interfere with any subsequent attempts to pour liquor from the bottle.

Another independent problem relating to the liquor trade is the unauthorized dilution or "watering" of liquor prior to its sale by unscrupulous dealers, etc. The problem of liquor watering is especially acute for liquor sold in certain areas outside of the United States. It would be generally desirable to provide a device which discourages such watering of liquor.

Finally, as with all consumable food and beverages, it would be desirable to provide a container which discourages tampering of any kind before the bottle is opened.

OBJECTS OF THE INVENTION

It is one object of the present invention to provide a liquor bottle capping assembly which provides a means for preventing flame propagation into a liquor bottle.

It is another object of the present invention to provide a liquor bottle capping assembly which discourages watering of the liquor in a liquor bottle.

It is a further object of the present invention to provide a liquor bottle capping assembly which provides evidence of tampering with the contents of the bottle.

It is another object of the present invention to provide a liquor bottle capping assembly which may be easily secured to existing liquor bottle configurations through the use of conventional crimping tools.

It is a further object of the present invention to provide a liquor bottle capping assembly which is a self-crimping capping assembly which may be installed on a liquor bottle simply by threading a cap portion thereof onto the threads of the liquor bottle.

It is a further object of the present invention to provide a liquor bottle capping assembly having a threaded cap portion for conventionally opening and resealing the liquor bottle subsequent to the initial opening of the liquor bottle.

It is a further object of the present invention to provide a liquor bottle capping assembly which is relatively inexpensive to produce.

It is a further object of the present invention to provide a liquor bottle capping assembly having a flame arrester portion which is resistant to the phenomena of crystallization and caramelization.

It is a further object of the present invention to provide a liquor bottle capping assembly having a flame arrester portion which provides a desirable liquor pour rate.

SUMMARY OF THE INVENTION

The present invention is directed to a liquor bottle capping assembly which may comprise:

perforated member means fixedly attachable to the liquor bottle in covering relationship with said threaded opening in the liquor bottle for preventing flame propagation into the liquor bottle;

penetration discouraging means operatively associated with said perforated member means for discouraging penetration and providing evidence of penetration of said perforated member means as by a hypodermic needle;

sheet means fixedly attached to said penetration prevention means and tearably removably attached to said perforated member means for sealing said bottle opening and for providing evidence of tampering with said capping assembly;

capping means threadably attachable and detachable on said threaded opening for providing a removable and reattachable closure for said liquor bottle opening.

The invention may also comprise a liquor container assembly comprising:

(a) container means for holding liquor therein, said container means having a restricted opening therein for pouringly dispensing said liquor therefrom;

(b) flame arrester means operatively associated with said container opening for enabling pouring of said liquor therethrough and for preventing propagation of flame therethrough whereby flame outside of said container means is prevented from propagating into said container means on liquor which is being poured from said container means and which is ignited by said outside flame;

liquor flow controlling means for enabling pouring of said liquor from said container means with a predetermined flow characteristic when said liquor is in an unwatered state and for substantially preventing the pouring of liquids of a greater surface tension than said liquor through said liquor flow controlling means for discouraging dilution of the alcoholic content of said liquor in said container means through pouring water into said container means and for providing evidence of watering of said liquor in the container means by providing a flow characteristic for substantially watered liquor that is noticeably different than said predetermined flow characteristic of said liquor in an unwatered state.

The invention may also comprise a liquor bottle capping assembly for a liquor bottle having a threaded opening comprising:

perforated member means fixedly attachable to the liquor bottle in covering relationship with said threaded opening in the liquor bottle for preventing flame propagation into the liquor bottle;

capping means threadably attachable and detachable on said threaded opening for providing a removable and reattachable closure for said liquor bottle opening;

said liquor bottle threaded opening comprising a top, horizontally extending, annular ring surface integrally connected with an annular, downwardly and inwardly extending surface at a peripheral edge surface;

said perforated member means having a horizontally extending portion adapted to abuttingly engage said bottle top horizontally extending surface and having a downwardly and outwardly extending annular flange portion adapted to frictionally engage an annular vertical surface of said capping means in a nondeformed state thereof prior to installation on said bottle, and adapted to engage said annular downwardly and inwardly extending surface of said bottle in a crimpingly inwardly deformed state thereof subsequent to installation on said bottle and having a perforated member annular shoulder portion connecting said horizontally extending portion and said annular flange portion;

said capping means comprising a downwardly extending flange portion with an inner surface having a threaded portion on a lower region thereof which is adapted to threadingly engage said bottle opening and having a cap annular shoulder portion on an upper region thereof and having a generally vertically extending annular portion positioned below said cap annular shoulder portion; said downwardly extending portion being adapted to receive said flange portion of said perforated member in holding frictional engagement therewithin prior to installation of said capping assembly on said liquor bottle and said cap shoulder portion being adapted to urge said perforated member means against said peripheral edge surface of said threaded bottle opening for deformingly forcing said flange portion of said perforated member means into crimpingly abutting engagement with said liquor bottle annular downwardly and outwardly extending surface;

whereby said perforated member is crimpingly attached to said liquor bottle through screwing said capping means onto said liquor bottle threaded opening whereby the need for crimping tools is obviated.

The invention may also comprise a method of preventing flame propagation into a liquor bottle when liquor is poured in the presence of flame comprising:

mounting a perforated metal member having holes therein sufficiently small to prevent flame propagation therethrough in covering relationship with the opening of the liquor bottle;

pouring liquor from the liquor bottle through said openings in the perforated member.

BRIEF DESCRIPTION OF THE DRAWING

An illustrative and presently preferred embodiment of the invention is shown in the accompanying drawing in which:

FIG. 3 is a top view of a perforated member portion of the liquor bottle capping assembly illustrated in FIGS. 1 and 2.

FIG. 4 is a cross sectional view of the perforated member illustrated in FIG. 3.

FIG. 5 is a bottom view of the perforated member illustrated in FIGS. 3 and 4.

FIG. 6 is a cross sectional view of a perforated member adapted for use in a self-crimping liquor bottle capping assembly.

DETAILED DESCRIPTION OF THE INVENTION

Figure 1:
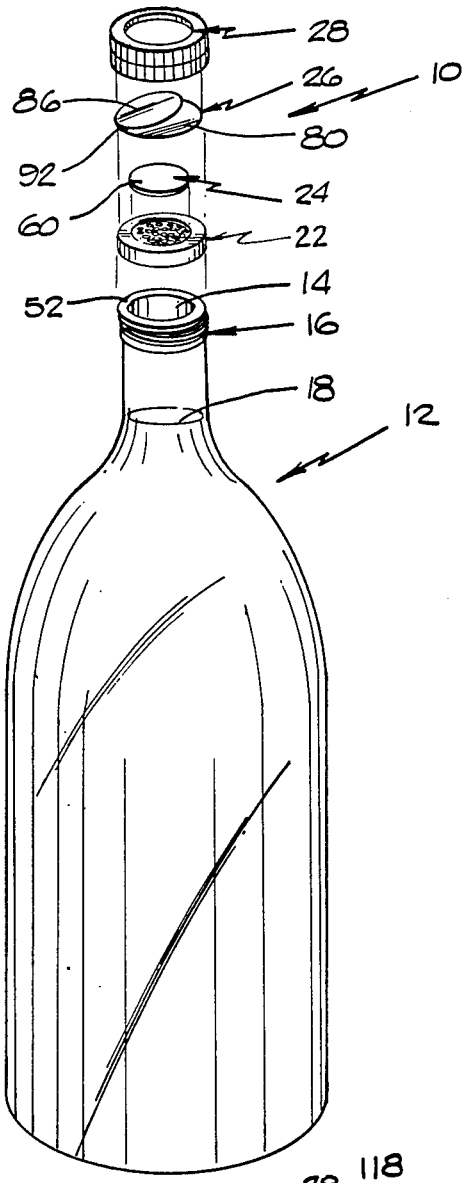
FIG. 1 is an exploded perspective view of a liquor bottle capping assembly.

As illustrated in FIG. 1, the liquor bottle capping assembly 10 of the present invention is adapted for use on a liquor bottle such as a rum bottle 12 having a restricted bottle opening 14 provided in a threaded neck portion 16 of the bottle. The liquor bottle 12 is, of course, filled with liquor 18 prior to installation of the capping assembly 10.

In general, the capping assembly 10 comprises a perforated member 22 which is fixedly attached to an upper portion of the bottle neck 16 in covering relationship with the bottle opening 14; a solid disk member 24 which is adapted to be positioned on a recessed perforated portion of the perforated member 22 to discourage penetration and provide evidence of penetration of the bottle enclosure as by a hypodermic needle, etc.; a sheet such as metal foil 26 which is adhered to a top portion of the solid disk member 24 and which is also adhered to a peripheral portion of the perforated member 22 to seal the bottle and provide evidence of attempted tampering with the contents of the bottle; and a cap member 28 which is adapted to be conventionally threaded onto threaded neck portion 16 to provide a resealable closure for the bottle subsequent to the non-reversible removal of the sheet member 26 and attached solid disk member 24. The perforated member 22 has a plurality of holes 42 therein which are sufficiently small in diameter to prevent propagation of flame therethrough and which are sufficiently large in diameter to permit discharge of liquor 18 from the bottle. The holes 42 are sufficiently large and numerous to provide a desirable liquor pour rate from the bottle, i.e. a relatively fast pour rate such as, e.g. a maximum rate of not less than 16 ounces per minute if the liquor has not been diluted with water. The sheet member 26 may be provided in two layers to facilitate grasping and removal thereof from its adhesive attachment to the perforated member 22. In one preferred embodiment, the sheet member is provided with a laser-imprinted hologram thereon which would become visible and provide a warning message if the sheet member were even slightly altered by tampering. Use of a holographic warning message on a label applied over a liquor bottle cap is known in the art. Such a label is commercially available from American Bank Note Holographics, Inc., 999 Plaza Drive, Suite 400, Shaumburg, Ill., 60195. In another embodiment, the sheet member is constructed of a metal foil, plastic film, metalized plastic, or other material which provides non-reversible evidence of wrinkling, creasing or tearing when tampered with.

Having thus described the invention in general, particular features of the invention will now be described in further detail.

Perforated member 22 is preferably formed from a flat, circular metal blank such as, for example, an aluminum blank having a thickness of preferably between 0.0090 inches and 0.0120 inches and most preferably 0.0105 inches for providing necessary strength and crimping characteristics. It has been discovered that treatment of such an aluminum blank with an oxidizing agent prevents crystal formation of the surface of the member when it is used with certain types of alcoholic beverages such as dark rum. One inexpensive manner of oxidizing such aluminum blanks is by soaking the blanks in a 3% hydrogen peroxide solution for ten minutes at room temperature. The perforated member, as best illustrated in FIG. 4, comprises a top portion 36, a bottom portion 38, an exterior surface 37, and an interior surface 39. The perforated member has an inner, circular, recessed, horizontally extending, perforated portion 40 which may have a diameter of, e.g. 0.614 inches. The perforated portion 40 is provided with a plurality of circular holes 42 which may have a diameter of between 0.060 inches and 0.075 inches and most preferably 0.063 (i.e. an area of between 0.0028 square inches and 0.0044 square inches, and most preferably 0.0031 square inches) inches for use with a liquor bottle containing 151 proof rum. The holes 42 are provided in a density which enables the holes to remain spaced apart from one another by a minimum distance of preferably 0.020 inches to enable the perforated portion to remain relatively strong to resist puncturing or rupture. The holes are preferably provided in a sufficient density to provide a total open hole area of between 0.105 square inches and 0.163 square inches and most preferably 0.115 square inches. It has been discovered that the flow rate of liquor of a predetermined alcoholic content through the perforated member is different than the flow rate of liquor which has been substantially diluted with water, i.e. liquor which has been substantially diluted with water tends to pour much more slowly, or not at all, than liquor which has not been diluted with water. Thus, use of the perforated member discourages the watering of liquor as by an unscrupulous bar owner, even after the sheet member 26 and disk member 24 have been removed because water is not easily poured into the bottle through the perforated member and because "watered" liquor pours out of the bottle more slowly than "unwatered" liquor. The above exemplary perforated portion dimensions have been found to prevent flame propagation into and to discourage watering of rum having an alcoholic content of 75%.

The perforated member 22 comprises a horizontally extending annular ring portion 44 which is positioned a small distance, e.g. 0.010 inches, above the perforated portion 40 and which is connected thereto by a downwardly and inwardly extending annular transition portion 46. The annular ring portion may have an outer diameter of approximately 0.915 inches and an inner diameter of approximately 0.614 inches. A downwardly extending annular flange portion 48 is connected to annular ring portion 44 by an annular shoulder portion 50 which may have a radius of curvature of, e.g., 0.015 inches. The downwardly extending portion 48 may have an axial length of, e.g., 0.090 inches.

The perforated member 22 is adapted for attachment to a bottle threaded neck portion 16 having a horizontally extending annular ring surface 52 which may have an outer diameter of 0.888 inches and an inner diameter of 0.614 inches and which is connected by an annular shoulder portion 51, which may have a radius of curvature of, e.g., 0.030 inches, to an annular downwardly and inwardly extending, e.g. at a 20 degree angle of inclination from a vertical axis, surface 54. Surface 54 is in turn connected to a downwardly and outwardly extending surface 55 which is integrally connected to the top portion of an outwardly projecting continuous male thread 56. Thread 56 projects radially outwardly from a vertically extending bottle neck surface 58. Perforated member 22 is positioned on top of horizontally extending annular ring surface 52 with the interior surface of annular ring portion 44 in abutting engagement with surface 52. In one embodiment of the invention, the downwardly extending annular flange 48 is crimpingly attached, i.e. bent inwardly into abutting relationship with annular downwardly and inwardly extending surface 54 by a conventional crimping tool. One conventional crimping device used for this purpose employes a high energy electromagnet to urge flange member 48 into abutting relationship with surface 54.

Figure 2:
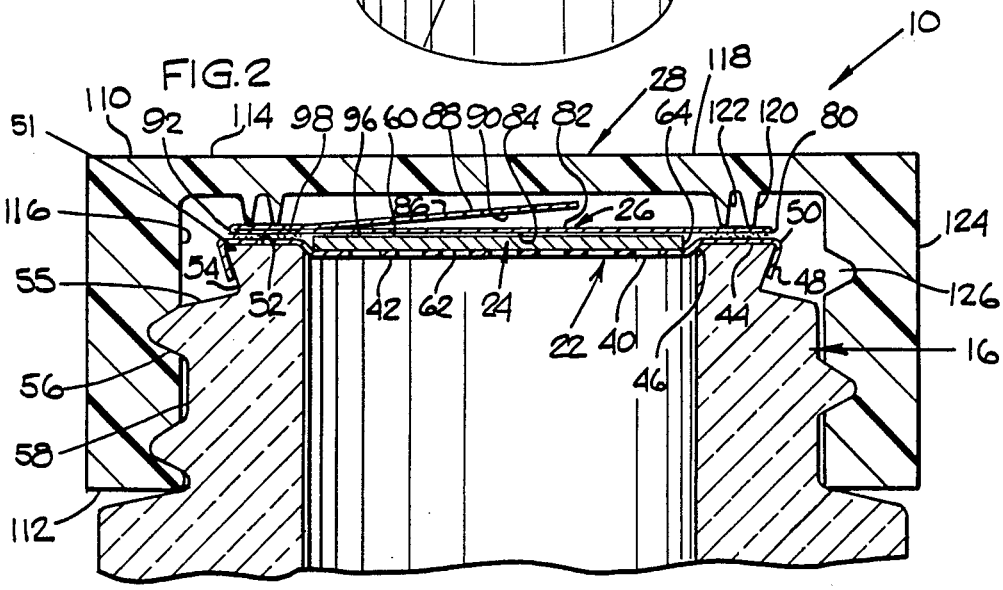
FIG. 2 is a detail cross sectional view of a liquor bottle capping assembly installed on a liquor bottle.

As illustrated in FIGS. 1 and 2, solid disk member 24 comprises a planar circular top surface 60, a planar circular bottom surface 62, and a cylindrical lateral edge surface 64. The diameter of the disk may be, e.g., 0.600 inches, and the thickness of the disk may be, e.g., 0.010 inches. The disk is preferably a metal disk such as aluminum but may also be constructed of high strength, high durometer plastic or other material which is sufficiently strong to resist and/or provide evidence of penetration by a hypodermic needle or the like. The solid disk member 24 is adapted to have a thickness approximately equal to the vertical distance between the perforated portion 40 and the annular ring portion 44 of perforated member 22 such that the top surface 60 of the disk is positioned at approximately the same elevation as the top surface of annular ring portion 44 of the perforated member.

As shown by FIGS. 1 and 2, sheet member 26 may comprise a circularly shaped first layer portion 80 having a first layer top surface 82 and a first layer bottom surface 84; a second layer portion 86 having a second layer top surface 88 and a second layer bottom surface 90. The first and second layers 80, 86 are integrally connected at fold portion 92. Second layer 86 is preferably somewhat smaller than first layer 88 and is adapted to be folded with bottom surface 90 thereof in abutting overlapping relationship with first layer top surface 82. An adhesive layer 96 may be provided for adhering surface 60 of disk member 24 to first layer bottom surface 84. Another adhesive layer 98 may be provided for adhering a peripheral portion of the first layer bottom surface 84 to the upper surface of perforated member annular ring portion 44. As an alternative to adhesive, ultrasonic welding or other attachment means may be employed. It will be understood that this configuration enables second layer portion 86 to act as a tab which may be lifted and grasped and pulled to remove the sheet member 26 and attached disk 24 from the perforated member, thereby exposing perforated portion 40 of the perforated member and enabling pouring of liquor 18 from bottle 12.

Cap member 28, as illustrated in FIG. 2, comprises a cap top portion 110, a cap bottom portion 112, a cap outside surface 114, a cap inside surface 116, a cap horizontally extending portion 118, which in turn comprises a pair of downwardly extending annular sheet engaging prong portions 120, 122 projecting from a lower surface thereof. The cap further comprises a downwardly extending annular flange portion 124 which has a continuous female threaded groove 126 provided therein which is adapted to threadingly engage continuous male thread portion 56 on bottle neck portion 16 to enable conventional threaded opening and closing of the liquor bottle with the cap member 28. The cap member may be threaded downwardly on the liquor bottle threaded neck portion 16 sufficiently far to enable engagement of annular prong portions 120, 122 with the top surface of perforated member annular ring portion 44 to form a seal therewith subsequent to the removal of sheet member 26.

Figure 7:
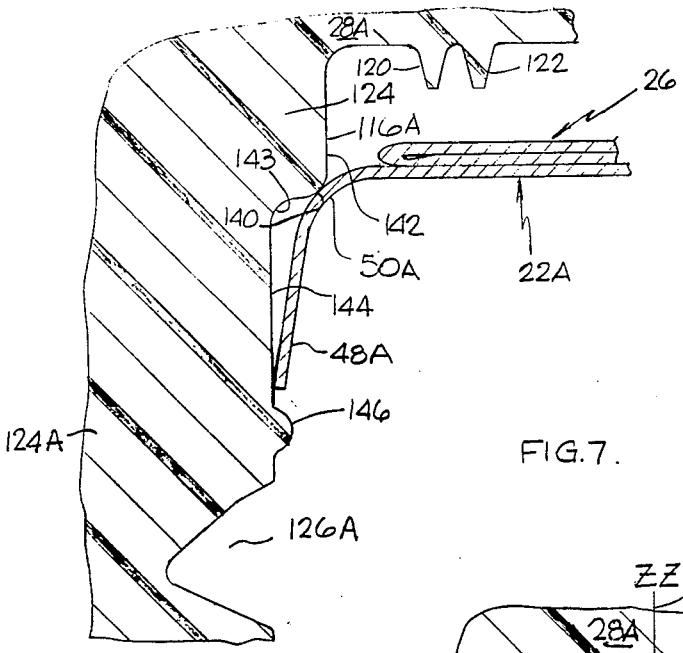
FIGS. 7–9 are detail cross sectional views of a self-crimping liquor bottle capping assembly in various states during installation of the capping assembly on a liquor bottle.

An embodiment of the invention which is adapted to provide a self-crimping capping assembly is illustrated in FIGS. 6–9. In this self-crimping assembly, a modified version of the perforated member 22A, FIG. 6, is initially resistance-fitted into cap 28, as illustrated in FIG. 7. The cap 28A is modified in a manner which allows it to act as a crimping tool which progressively crimps the perforated member 22A onto the bottle as the cap is screwed onto the bottle.

Figure 8:
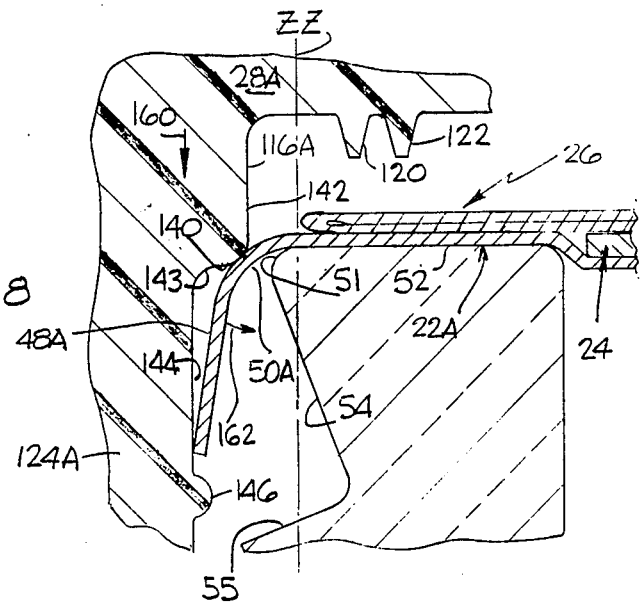
Figure 9:
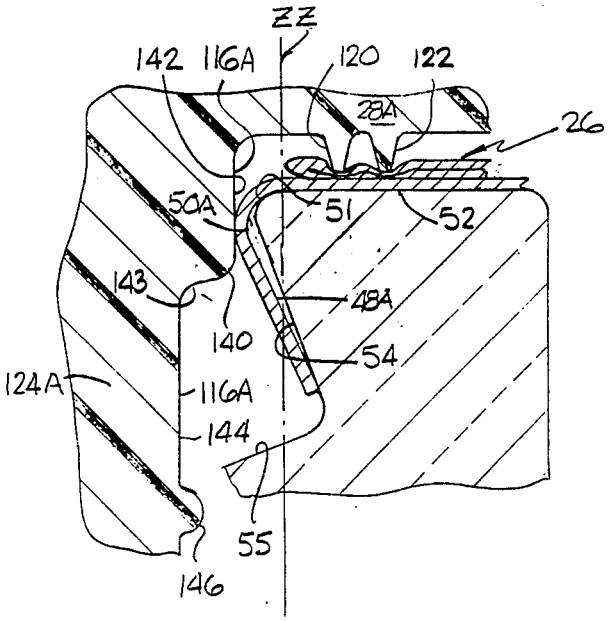

In this embodiment, cap 28A is identical to the cap 28 described above with reference to FIGS. 1 and 2, except that the inside surface 116A of cap 28A downwardly extending annular flange portion 124A is provided with an annular curved shoulder surface 140 at an upper portion thereof. The annular shoulder surface 140 is integrally connected at an upper portion thereof to upper annular vertical surface 142. The shoulder surface 140 is integrally connected at the lower portion thereof to lower annular vertical surface 144 by annular small radius connecting surface 143. Cap 28A shoulder surface 140 has a radius of curvature approximately equal to that of the bottle shoulder portion 51, e.g. 0.030 inches. The radial distance between vertical surfaces 142 and 144 may be 0.100 inches. The radial distance between surface 142 and shoulder portion 51 of the bottle may be, e.g., 0.060 inches. In this embodiment, perforated member shoulder portion 50A has a radius of curvature approximately three times as large as the curvature of bottle shoulder surface 51, e.g. 0.090 inches. This radius of curvature of shoulder portion 50A, when member 22A is positioned within cap 28A, has its center of curvature located at a point which lies on the same vertical axis ZZ as that on which the center of curvature of bottle shoulder portion 51 is located. The curvature of shoulder 50A terminates at a position such that annular flange portion 48A projects downwardly and outwardly. The lower vertical surface 144 of cap 28A is of a sufficiently small diameter to provide a resistance fit with the perforated member annular flange portion 48A when perforated member 28A is urged upwardly into the cap, as illustrated in FIG. 7. As also shown by FIG. 7, the center of shoulder portion 140 is positioned at a radial distance from the center of cap 22A which is approximately equal to the radial distance at which the center of perforated member shoulder portion 50A is positioned from the center of the perforated member. Thus, shoulder surface 140 initially acts as a locating or stop surface which halts the axial advance of perforated member 28A when it is initially positioned in cap 28A. An annular retaining ring 146 may be provided on cap lower vertical surface 144 to retain the perforated member within the cap subsequent to its insertion therein. The cap 28A and perforated member 22A thus comprise a self-crimping capping assembly. As shown in FIG. 8, as the cap 28A is initially screwed downwardly as indicated at 160, the perforated member comes into abutting engagement with the top horizontal surface 52 of the bottle. As illustrated by 162 in FIG. 8, as the cap continues its axial downward advancement, the flange portion 48A is crimpingly urged inwardly by surface 140. As shown by FIG. 9, the axial downward advancement of the bottle eventually causes flange portion 48A to be urged into abutting engagement with the bottle downwardly and inwardly extending surface 54 through bending of the perforated member at annular shoulder portion 50 thereof initially by cap surface 140 and subsequently by cap surface 142. Thus, in this embodiment, a capping assembly comprising perforated member 22A, disk member 24, sheet 26 and cap 28A may be crimpingly mounted on the bottle simply through firmly screwing the bottle cap onto the bottle threaded end portion. No separate crimping tools are required.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A liquor bottle capping assembly for a liquor bottle having a threaded opening comprising:

perforated member means fixedly attachable to the liquor bottle in covering relationship with said threaded opening in the liquor bottle for preventing flame propagation into the liquor bottle;

wherein said perforated member means comprises a relatively thin member having a plurality of holes in a central portion thereof;

wherein said perforated member means holes comprise circular holes;

wherein said circular holes in said perforated member means comprise a diameter range of between 0.060 inches and 0.075 inches.

2. The invention of claim 1 wherein said perforated member means is provided with a plurality of holes having a total open area of between 0.105 square inches and 0.163 square inches in the area thereof covering said opening in said liquid bottle.

3. The invention of claim 2 wherein said perforated member means comprises a total open area of approximately 0.115 square inches in the area thereof covering said opening and wherein said holes each comprise a diameter of approximately 0.063 inches.

4. The invention of claim 2 wherein said perforated member means is constructed from oxidized aluminum.

5. The invention of claim 4 wherein said perforated member means comprises a thickness of approximately 0.0105 inches.

6. The invention of claim 5 said perforated member means further comprising attachment means for fixedly attaching said perforated member means to said liquor bottle.

7. The invention of claim 6 said attachment means comprising flange means fixedly crimped to a threaded opening portion of said liquid bottle.

8. A liquor bottle capping assembly for a liquor bottle having a threaded opening comprising:

perforated member means fixedly attachable to the liquor bottle in covering relationship with said threaded opening in the liquor bottle for preventing flame propagation into the liquor bottle;

penetration discouraging and evidence providing means operatively associated with said perforated member means for preventing penetration of said perforated member means as by a hypodermic needle and for providing evidence of a penetration;

sheet means fixedly attached to said penetration prevention means and tearably removably attached to said perforated member means for sealing said bottle opening and for providing evidence of tampering with said capping assembly;

said penetration prevention means comprising a thin metal disk adapted to be positioned in covering relationship with a perforated portion of said perforated member means;

wherein said perforated portion of said perforated member means is recessed from a surrounding portion thereof and wherein said metal disk has a thickness approximately equal to the depth of recess of said recessed perforated portion.

9. The invention of claim 8 wherein said sheet means is adhesively attached to said metal disk and is adhesively attached to a peripheral portion of said perforated member means.

10. The invention of claim 9 wherein said sheet means comprises a foil of the type which is readily and nonreversibly creasingly and tearingly deformable whereby creasing or tearing deformation of said foil provides evidence of tampering.

11. The invention of claim 9 said sheet means being provided with a hologram which becomes visible subsequent to deformation of the sheet means such as caused by tampering, said hologram providing a warning message.

12. A liquor container assembly comprising:

(a) container means for holding liquor therein, said container means having a restricted opening therein for pouringly dispensing said liquor therefrom;

(b) flame arrester means operatively associated with said container opening for enabling pouring of said liquor therethrough and for preventing propagation of flame therethrough whereby flame outside of said container means is prevented from propagating into said container means on liquor which is being poured from said container means and which is ignited by said outside flame;

(c) liquor flow controlling means for enabling pouring of said liquor from said container means with a predetermined flow characteristic when said liquor is in an unwatered state and for substantially preventing the pouring of liquids of a greater surface tension than said liquor through said liquor flow controlling means for discouraging dilution of the alcoholic content of said liquor in said container means through pouring water into said container means and for providing evidence of watering of said liquor in the container means by providing a flow characteristic for substantially watered liquor that is noticeably different than said predetermined flow characteristic of said liquor in an unwatered state.

13. The invention of claim 12 wherein said flame arrester means and said liquor flow controlling means comprise a perforated member means fixedly attachable to said container means in covering relationship with said restricted opening; said perforated member means comprising a relatively thin metal member having a plurality of holes in a central portion thereof and having an integrally formed flange means for fixedly attaching said perforated member means to said container means.

14. The invention of claim 13 wherein said holes in said perforated member have diameters of at least 0.060 inches.

15. The invention of claim 14 wherein said holes in said perforated member have diameters of less than 0.075 inches.

16. A liquor container assembly comprising:

(a) container means for holding liquor therein, said container means having a restricted opening therein for pouringly dispensing said liquor therefrom;

(b) liquor flow controlling means for enabling pouring of said liquor from said container means with a predetermined flow characteristic when said liquor is in an unwatered state and for substantially preventing the pouring of liquids of a greater surface tension than said liquor through said liquor flow controlling means for discouraging dilution of said alcoholic content of the liquor in said container means through pouring water into said container means and for providing evidence of watering of said liquor in said container means by providing a flow characteristic for substantially watered liquor that is noticeably different than said predetermined flow characteristic of said liquor in an unwatered state.

17. A liquor bottle capping assembly for a liquor bottle having a threaded opening comprising:

perforated member means fixedly attachable to the liquor bottle in covering relationship with said threaded opening in the liquor bottle for preventing flame propagation into the liquor bottle;

capping means threadably attachable and detachable on said threaded opening for providing a removable and reattachable closure for said liquor bottle opening;

said liquor bottle threaded opening comprising a top, horizontally extending, annular ring surface integrally connected with an annular, downwardly and inwardly extending surface at a peripheral edge surface;

said perforated member means having a horizontally extending portion adapted to abuttingly engage said bottle top horizontally extending surface and having a downwardly and outwardly extending annular flange portion adapted to frictionally engage an annular vertical surface of said capping means in a nondeformed state thereof prior to installation on said bottle, and adapted to engage said annular downwardly and inwardly extending surface of said bottle in a crimpingly inwardly deformed state thereof subsequent to installation on said bottle and having a perforated member annular shoulder portion connecting said horizontally extending portion and said annular flange portion;

said capping means comprising a downwardly extending flange portion with an inner surface having a threaded portion on a lower region thereof which is adapted to threadingly engage said bottle opening and having a cap annular shoulder portion on an upper region thereof and having a generally vertically extending annular portion positioned below said cap annular shoulder portion; said downwardly extending portion being adapted to receive said flange portion of said perforated member in holding frictional engagement therewithin prior to installation of said capping assembly on said liquor bottle and said cap shoulder portion being adapted to urge said perforated member means against said peripheral edge surface of said threaded bottle opening for deformingly forcing said flange portion of said perforated member means into crimpingly abutting engagement with said liquor bottle annular downwardly and outwardly extending surface;

whereby said perforated member is crimpingly attached to said liquor bottle through screwing said capping means onto said liquor bottle threaded opening whereby the need for crimping tools is obviated.

18. The invention of claim 17 further comprising:

penetration discouraging and evidence providing means operatively associated with said perforated member means for preventing penetration of said perforated member means as by a hypodermic needle and for providing evidence of an attempted penetration.

19. The invention of claim 18 further comprising:

sheet means fixedly attached to said penetration prevention means and tearably removably attached to said perforated member means for sealing said bottle opening and for providing evidence of tampering with said capping assembly.

20. A method of capping a liquor bottle comprising:

(a) providing perforated member means fixedly attachable to the liquor bottle in covering relationship with said threaded opening in the liquor bottle for preventing flame propagation into the liquor bottle; capping means threadably attachable and detachable on said threaded opening for providing a removable and reattachable closure for said liquor bottle opening; said liquor bottle threaded opening comprising a top, horizontally extending, annular ring surface integrally connected with an annular, downwardly and inwardly extending surface; said perforated member having a horizontally extending portion adapted to abuttingly engage said bottle top horizontally extending surface and having a downwardly and outwardly extending annular flange portion adapted to frictionally engage one surface portion of said capping means in a nondeformed state thereof prior to installation on said bottle, and having annular shoulder portion connecting said annular flange portion and said horizontally extending portion adapted to be urged by another surface portion of said capping means into abutting relationship with said annular downwardly and inwardly extending surface of said bottle in a crimpingly inwardly deformed state thereof subsequent to installation on said bottle;

(b) inserting said perforated member means in resistance fitting relationship within said capping means;

(c) screwing said capping means onto said threaded opening of said liquor bottle.

21. A liquor bottle covering assembly for covering a liquor bottle opening for preventing flame propagation into the liquor bottle during pouring of liquor therefrom, comprising:

a unitary, unwoven, perforated, relatively thin metal member means which is self-attachable to the liquor bottle in covering, substantially nonpenetrating relationship with the liquor bottle opening;

said perforated member means having a plurality of holes in a relatively flat central portion thereof and having an integrally formed flange for attaching said perforated member means to said liquor bottle.

22. The invention of claim 21 wherein said holes in said perforated member means comprise a diameter range of between 0.060 inches and 0.075 inches.

23. The invention of claim 21 wherein said holes in said perforated member means each has an area of less than 0.0044 square inches.

24. The invention of claim 21 wherein said holes in said perforated member means each has an area of greater than 0.0028 square inches.

25. The invention of claim 23 wherein said holes in said perforated member means each has an area of greater than 0.0028 square inches.

26. A liquor bottle capping assembly for a liquor bottle having a threaded opening comprising:

(a) capping means threadably attachable and detachable on said threaded opening for providing a removable and reattachable closure for said liquor bottle opening;

(b) perforated member means fixedly attachable to the liquor bottle in covering relationship with said threaded opening in the liquor bottle for preventing flame propagation into the liquor bottle;

(c) penetration discouraging and evidence providing means operatively associated with said perforated member means for preventing penetration of said perforated member means as by a hypodermic needle and for providing evidence of a penetration;

(d) sheet means fixedly attached to said penetration prevention means in covering relationship therewith and tearably removably attached to said perforated member means for sealing said bottle opening and for providing evidence of tampering with said capping assembly.

* * * * *